US005477608A

United States Patent [19]

Woll

[11] Patent Number: 5,477,608

[45] Date of Patent: Dec. 26, 1995

[54] APPARATUS FOR CONNECTING A WIRE TO A CONTACT ELEMENT

[75] Inventor: Matthias Woll, Bad Schönborn-Langenbrücken, Germany

[73] Assignee: Bernhard Schafer Werkseug-und Sondermaschinenbau GmbH, Langenbrucken, Germany

[21] Appl. No.: 150,445

[22] Filed: Nov. 9, 1993

[30] Foreign Application Priority Data

Nov. 11, 1992 [DE] Germany ..... 42 38 018.9
Dec. 2, 1992 [DE] Germany ..... 42 40 498.3

[51] Int. Cl.[6] ..... H01R 43/048

[52] U.S. Cl. ..... 29/753; 29/863; 72/402

[58] Field of Search ..... 29/33 M, 748, 29/753, 761, 863; 72/447, 452, 402; 100/232, 237

[56] References Cited

U.S. PATENT DOCUMENTS

| | | | |
|---|---|---|---|
| 2,733,458 | 2/1956 | Trumit | 72/402 X |
| 2,970,500 | 2/1961 | Appel | 72/402 |
| 3,155,137 | 11/1964 | Stoltz | 72/402 X |
| 4,041,766 | 8/1977 | Johnson et al. | 29/753 X |
| 4,178,679 | 12/1979 | Lichtenstein | 29/753 X |
| 4,229,963 | 10/1980 | Savinov et al. | 72/452 X |
| 4,711,484 | 9/1986 | Kissinger, Jr. et al. . | |
| 4,730,384 | 3/1988 | Frohlich | 29/753 X |
| 4,856,183 | 8/1989 | Belaidouni et al. | 29/753 |
| 4,905,490 | 3/1990 | Pahnke | 72/402 |

FOREIGN PATENT DOCUMENTS

| | | | |
|---|---|---|---|
| 573800 | 4/1959 | Canada | 72/402 |
| 1145871 | 10/1957 | France | 72/402 |
| 4039051 | 5/1992 | Germany | 29/753 |
| 723433 | 2/1955 | United Kingdom | 72/402 |

*Primary Examiner*—Peter Vo
*Attorney, Agent, or Firm*—Bachman & LaPointe

[57] ABSTRACT

In an apparatus for connecting a wire to a contact element by deformation of clamping portions of the contact element by means of pressure members, in particular pressure members of a crimping tool (20) which is arranged interchangeably in an impact press and which has a crimping punch (28) which in a crimping position produces the deformation, for the purposes of producing a plurality of deformation regions on the contact element, a number of crimping punches (28), said number corresponding to the number of the deformation regions, is arranged around a receiving opening, each of which crimping punches can be moved by pressure jaws (46, 47) towards the receiving opening into the crimping position, wherein the pressure jaws (46, 47) are movable by pressure punches (40, **40*a*) which are provided at an angle with respect thereto. The pressure punches are arranged on both sides of a straight line of symmetry (M) and substantially parallel thereto, with surfaces which are inclined at an angle to the line of symmetry (M) and which engage into the path of movement (44) of inclined surfaces of the pressure jaws (46, 47**).

20 Claims, 3 Drawing Sheets b1
b
39
40a
41
42
42s
50
52
53
54
55
56
e
n1
q
w
39t
XIII
46
60
66
x
t
i
g
47
64
f
58
62
61
61a
Q

APPARATUS FOR CONNECTING A WIRE TO A CONTACT ELEMENT

BACKGROUND OF THE INVENTION

The invention concerns an apparatus for connecting a wire to a contact element or the like by deformation of clamping or terminal portions of the contact element or the like by means of pressure members, in particular pressure members of a crimping tool which is arranged interchangeably in an impact press and which has a movable crimping punch or plunger which in a crimping position produces the deformation. The invention also concerns a connecting process for contact elements.

Apparatuses of that kind for cable manufacture, for example for fixedly connecting wire ends to plugs and cable shoes or connector lugs, usually comprise an impact press with a vertically movable pressing punch or plunger which acts on a pressure head of the crimping tool which is disposed therebeneath, wherein crimping punches or plungers provided in the crimping tool are moved downwardly and secure a horizontally inserted plug member or the like contact element to the end of a cable or wire, by virtue of the deformation of clamping or terminal lugs. The end of the cable or wire is stripped of its insulation to a certain length so as to provide a diameter which is smaller than the insulated portion. The so-called crimping dimension of the punch edge or edges acting on the wire, being the dimension that is necessary for the described crimping procedure, is adjusted by hand in dependence on the cross-section of the wire and the form of the contact element.

An apparatus of the kind set forth above having a shaping punch or plunger or crimper member, by means of which sheet metal lugs are connected to a cable by deformation is described in the present applicants' German laid-open specification (DE-OS) No. 40 39 051. The edges of the sheet metal lugs which are of a U-shape configuration in cross-section are rolled in by the crimper member so as to produce a structure which is approximately heart-shaped, also in cross-section.

It is often necessary for a plurality of inwardly directed radial deformation portions to be produced in sleeve-like or tubular contacts, for which purpose for example star-like wheels on a lever arm are known, the wheels rotating about an axis, with a plurality of impact surfaces. Such apparatuses are provided with their own drive and are overall of an individual configuration, that is to say they are designed specifically for a respective contact and are therefore expensive.

In consideration of that state of the art, the inventor set himself the aim of designing an apparatus of the kind set forth in the opening part of this specification for producing a plurality of inwardly directed deformation portions in a sleeve-like contact element and in the form of a quick-change tool for impact presses. The latter can then be used as a flexible basic piece of equipment.

That object is attained by the teaching of the independent claims; the appendant claims set forth advantageous developments.

To produce a plurality of deformation regions on the contact element, a number of crimping punches or plungers, said number corresponding to the number of deformation regions to be produced, is arranged around a receiving opening, which crimping punches can be moved by pressure jaws or the like members into the crimping position, wherein the pressure jaws or the like members are in turn movable by pressure punches or plungers which are provided at an angle with respect thereto.

For that purpose, it has proven to be desirable to arrange on both sides of a straight line of symmetry, pressure punches, which are substantially parallel thereto, of the crimping tool, which punches engage into the path of movement of inclined surfaces of the pressure jaws, by means of surfaces which are inclined at an angle relative to the axis of symmetry.

In accordance with the invention, for the purposes of return movement of the pressure jaw, disposed in opposite relationship to the inclined surface or surfaces thereof is a respective parallel inclined surface which is associated with a second inclined surface of said pressure punch. The co-operating return surfaces of the pressure jaws and the pressure punches extend inclinedly relative to the axis of symmetry, in order to restore the initial position.

In accordance with a further feature of the invention the pressure jaw has a taper surface which crosses the axis of the associated crimping punch and can be pressed against a punch surface which is parallel thereto. In accordance with the invention the crimping punch is returned from the crimping position by a force-storage means, in particular a compression spring.

It has also been found desirable for the axis of the crimping punch to be disposed approximately at a right angle relative to the taper surface and/or for the crimping punch to be arranged to be movable against the force of a force-storage means into the crimping position.

Advantageously, both the taper surface and also an oppositely inclined oblique groove are formed in a parallelepipedic block of material, wherein the inclined groove affords the inclined surfaces for the crimping and return movement.

In accordance with another feature of the invention, engaging into the inclined groove in the pressure jaw is a rib which projects from the pressure punch in a bar-like configuration and which has said inclined surfaces. Those pressure punches which are connected to a rotary head that can be raised and lowered can also be produced in a simple manner by a cutting machining operation from a block of material.

The pressure jaw is guided towards the crimping punch against the force of a force-storage means which—preferably in the form of a coil spring—embraces a securing pin which is connected to the pressure jaw and which passes through a fixed guide.

The above-mentioned guide for the securing pin is a bore in a part of a housing in which slide tracks for the pressure jaws extend. Thrust tracks for the pressure punches are directed transversely to said slide tracks.

It is in accordance with the invention for an interchangeable crimping insert to be arranged between the thrust tracks and for the crimping insert to be provided with guides for the crimping punches. Those guides are disposed radially relative to the receiving opening in the crimping insert.

In accordance with the invention, by means of a tool of such a configuration, the force of the press is distributed to the pressure punches or plungers of the crimping tool and each force portion of the crimping punch is converted into at least a force which is at an angle relative thereto; that force acts on the crimping punch.

BRIEF DESCRIPTION OF THE DRAWINGS

Further advantages, features and details of the invention will be apparent from the following description of preferred embodiments and with reference to the drawings in which.

DETAILED DESCRIPTION OF THE DRAWINGS

Figures 1, 2, 3, 4, 5, 6:
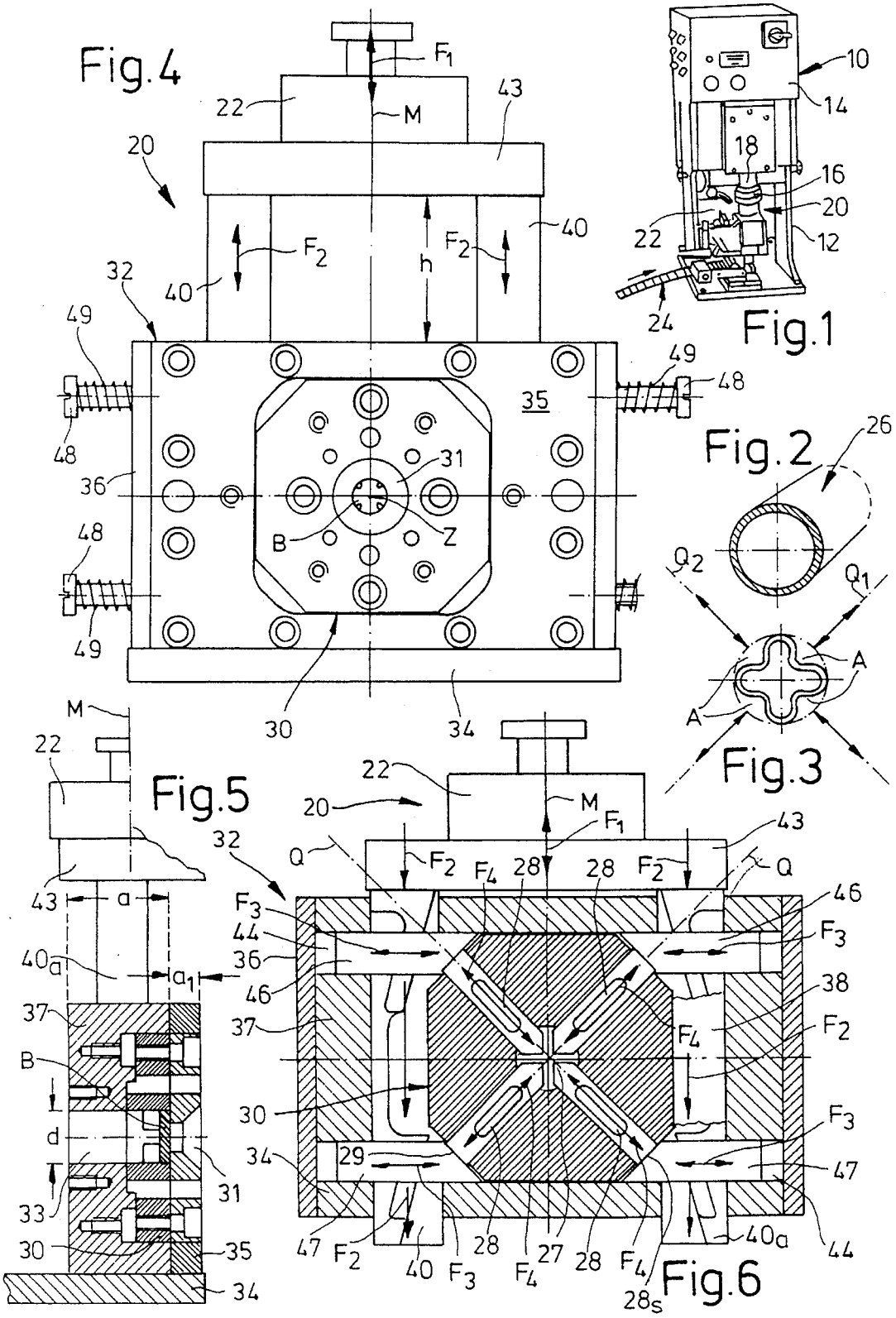
FIG. 1 shows a perspective view of a crimping tool in an impact press.
FIG. 2 shows a perspective view on an enlarged scale of a part of a sleeve-like contact element.
FIG. 3 shows a view in cross-section through the contact element after a deformation operation.
FIG. 4 shows a front view of the crimping tool.
FIG. 5 shows a view taken along line M through the crimping tool, on a reduced scale in comparison with FIG. 4.
FIG. 6 shows a view in cross-section through the crimping tool with left-hand and right-hand pressure punches, crimping insert disposed therebetween and lateral pressure jaws associated with the crimping insert.

An impact press 10 for dealing with wires or cables comprises, beneath a press housing 14 which contains control and pressure devices and which is disposed on support legs 12 and which has an adjusting plate 16 and pressing punch or ram 18, with an operating stroke of 40 mm, a quick-change crimping tool 20 with rotary head 22 which is acted upon by the pressing punch or ram 18. This unit 10/20 serves for connecting an insulated electrical wire to a sleeve-like or tubular contact element 26 which is separated from a sheet metal strip or line of blanks 24. The contact element is pressed or crimped onto the end of the wire, from which the insulation has been previously removed, and the adjoining portion of the insulation, by deformation; in the crimping operation the sleeve 26 is deformed in such a way that for example the flexible conductor wire at the end of the wire flows and air pockets or inclusions are obviated.

As shown in FIG. 3 deformation occurs in four regions A which are determined by two cross-sectional straight lines Q1, Q2 which are disposed approximately at a right angle to each other. Four crimping punches or plungers 28 move in guides 29 in a crimping insert 30 in the crimping tool 20 in the above-mentioned cross-sectional straight lines Q1, Q2 which intersect the central axis M of the tool at the center point Z of the tool. The axes Q of the crimping punches 28 therefore coincide with the cross-sectional straight lines Q1, Q2.

As FIG. 4 clearly shows, the crimping insert 30 is interchangeably disposed in a housing 32 which is provided with a bottom plate 34, a front plate 35 of a thickness a1 of 10 mm, side plates 36 and a housing body 37; the depth thereof as indicated at a measures 35 mm here, while the diameter d of a central bore 33 is about 18 mm. The crimping region B of the crimping insert 30 can be seen through an inwardly tapering aperture 31 in the front plate 35, the aperture 31 also being central.

Two pressure punches or plungers 40, **40*a* engage from above into vertical thrust tracks 38 in the housing body 37 and are screwed with their punch head surface 39 to a transverse plate 43 of the rotary head 22. The transverse plate 43 is at a spacing h relative to the housing 32 (see FIGS. 4 and 7) in the upper dead center position of the press 10. When the press 10 is in its lower dead center position, the transverse plate 43 extends near the housing body 37 as shown in FIGS. 6 and 8**.

Extending transversely to the center line M of the tool, in the housing 32, are horizontal slide tracks 44 for upper pressure jaws 46 and lower pressure jaws 47, which coincide with the axes of securing pins 48. The latter each pass through a respective bore **36*a* in a side plate 36 and are embraced by a spring 49 which bears against the side plate 36 and the pin head 48*a***.

Figure 7:
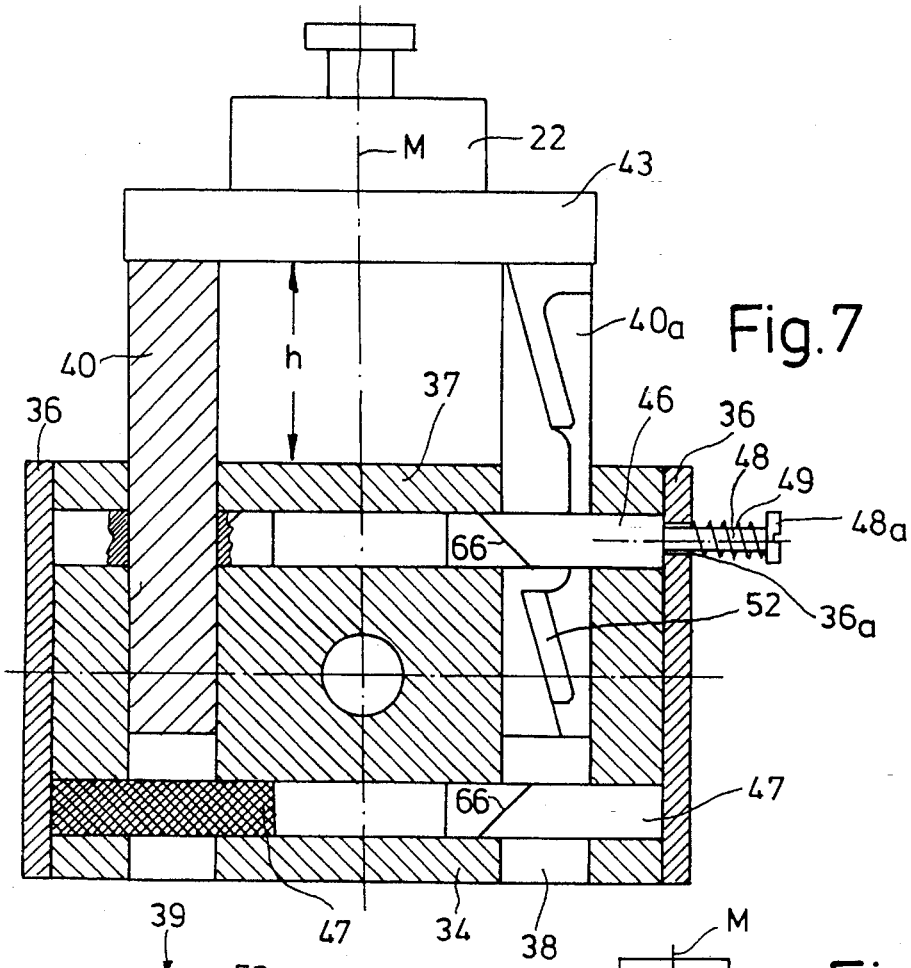
FIG. 7 shows a view in cross-section through the crimping tool in the top dead center position.
Figure 9:
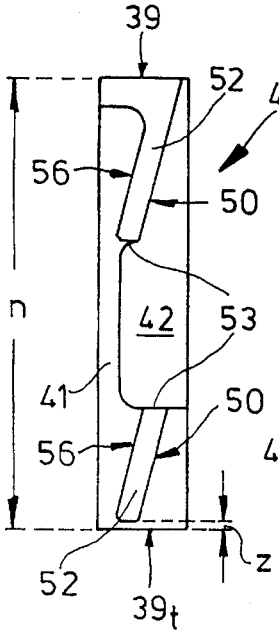
FIG. 9 shows the left-hand pressure punch of the crimping tool.
Figure 8:
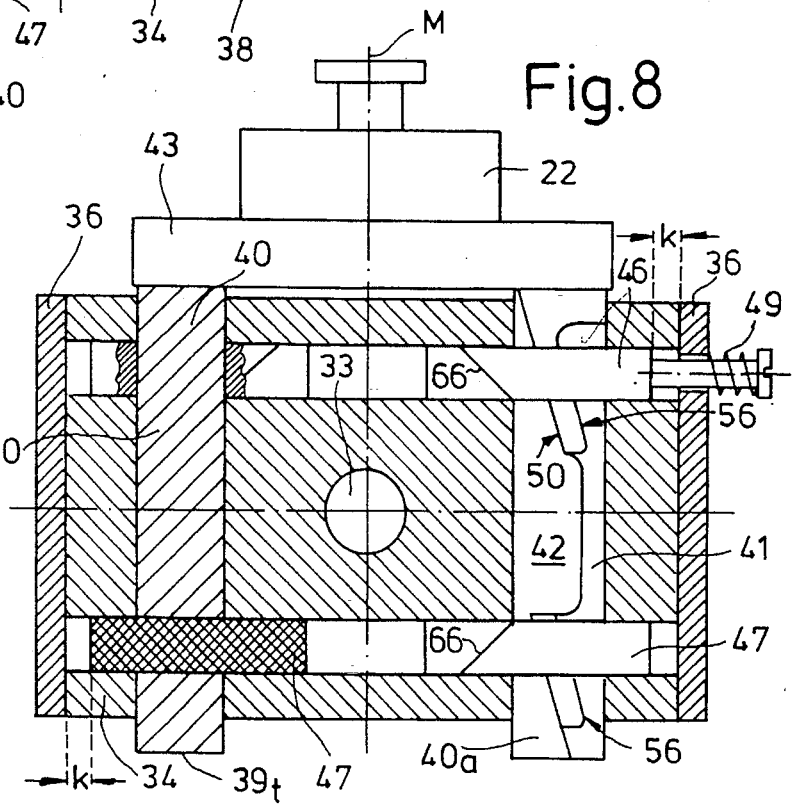
FIG. 8 shows a view in cross-section through the crimping tool in the lower dead center position.

Different positions of the pins 48 which are fixed with their shank to the pressure jaws 46, 47 are indicated at top right in FIGS. 7 and 8. If the pressure jaw 46, 47 were not secured by the securing pin 48 and the spring 49 it could move in its basic position on the horizontal axis and thus damage the tool in the working stroke movement; the spring 49 holds the pressure jaw 46, 47 in position.

The movements of the tool portions during the shaping operation and the forces involved therein are indicated by arrows in FIG. 6, with the following meanings:

$F_1$=vertical pressing stroke movement;

$F_2$=transmission of $F_1$ in the form of a longitudinal stroke movement to the pressing punches 40, **40*a* of the crimping tool 20**;

$F_3$=transmission of the longitudinal stroke movement $F_2$ for the transverse stroke movement of the pressure jaws 46, 47; and $F_4$=transmission of the transverse stroke movement $F_3$ in the form of a diagonal stroke movement for the crimping punches 28.

A wedge or taper system which is described hereinafter is used to perform that sequence of stroke movements.

The pressing stroke movement which is transmitted from the press 10 to the rotary head 22 permits individual tool setting; the force F1 is distributed by way of the transverse plate 42 to the left-hand and right-hand pressure punches or plungers 40, **40*a*—each of a width b of 19 mm but with different lengths as indicated at n, n1 of 94 mm for the left-hand pressure punch 40 and 100 mm for the right-hand pressure punch 40*a*. The stroke movement of 40 mm of the press 10** is directly transmitted to the two pressure punches so that they are also capable of performing a stroke movement of that order of magnitude.

The pressure punches 40, **40*a* are each provided with two inclined pressure surfaces 50 which are presented at an angle w of about 15° as side surfaces of ribs 52 and which project by a dimension e of 3 mm here beyond a first front surface 41 of the pressure punch 40, the depth b1 of which is about 15 mm. Towards the crimping insert 30, a transversely extending shoulder step 42***s* is formed between the first or outer front surface 41 and a second —inner—front surface 42. The mutually facing end faces of the ribs 52 are identified by reference 53 and the upper rib 52 is of a configuration like a "7" in front view; the end of the transverse bar portion of the upper rib 52, that transverse bar portion extending at the punch head surface 39, is indicated at 54. The base surface 55 of the lower rib 50 which forms a straight line is disposed at a spacing z relative to the lower punch surface 39*t*; it is shorter in the case of the left-hand pressure punch 40 than in the case of the other.

If the pressure punch 40—and equally the other pressure punch 40*a*—moves downwardly on the other side of the axis of symmetry M, the vertically moved inclined pressure surfaces 50 as well as the parallel inclined back surfaces 56 of the ribs 52, which are each provided on the other side of the respective rib, exactly co-operate with corresponding inclined surfaces 58 and back surfaces 60 respectively of the horizontally guided pressure jaws 46, 47. In that situation the vertical force F2 produces the horizontal force F3 and the longitudinal movement turns into a transverse movement.

The pressure punches 40, 40*a* and the pressure jaws 46, 47 have a positive pull-back action so that, upon retraction of the press 10, the pressure jaws 46, 47 which are guided in the slide tracks 44 are pulled back into the basic position shown in FIG. 7.

Figures 10, 11, 12, 13, 14, 15, 16, 17, 18, 19:
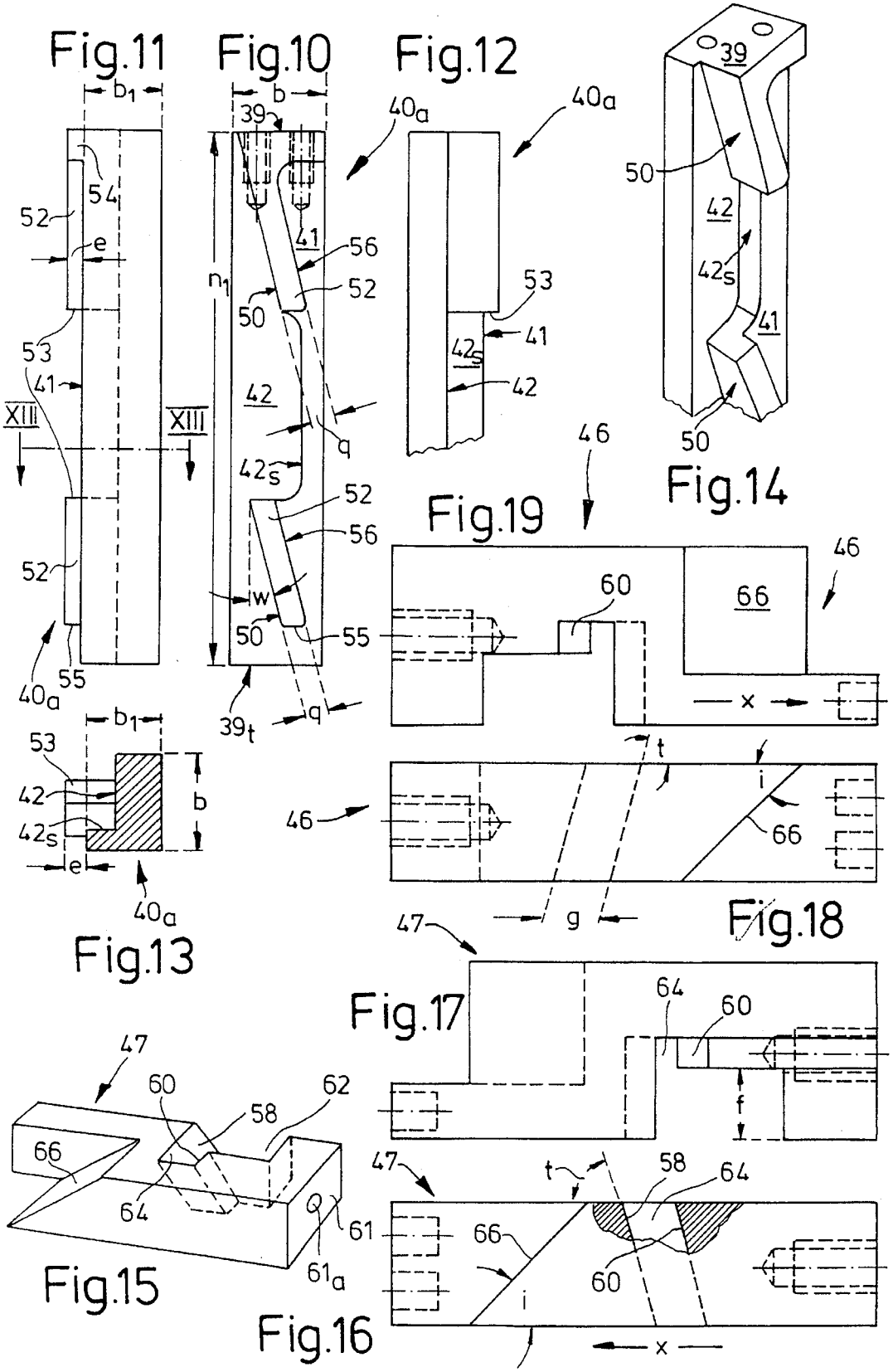
FIG. 10 shows a front view of the right-hand pressure punch, on an enlarged scale in comparison with FIG. 9.
FIG. 11 shows a side view of FIG. 10.
FIG. 12 shows a part of the other side view of FIG. 10.
FIG. 13 shows a view in section through FIG. 11 taken along line XIII—XIII.
FIG. 14 shows a perspective view of the upper region of the pressure punch shown in FIGS. 10 through 13.
FIG. 15 is a perspective view of the lower pressure jaw at the right in FIGS. 6 through 8.
FIG. 16 is an enlarged side view of FIG. 15.
FIG. 17 is a view under the pressure jaw shown in FIGS. 15 and 16.
FIG. 18 is a side view of the upper left-hand pressure jaw shown in FIG. 6.
FIG. 19 is a view under, the pressure jaw shown in FIG. 18.

As shown in particular in FIG. 15, provided in the pressure jaw 47, in this case the lower right pressure jaw, which is made from a workpiece parallelepiped, is a lateral cut-out or recess 62 of a depth f of 7 mm here, from the inside surface of which an inclined groove 64 of a width g of 5 mm extends at an angle of inclination t in the pressing direction x of about 75°, the side walls thereof being the above-mentioned inclined surface 58 and the back surface 60. FIG. 15 also shows in the end surface 61 of the parallelepiped a bore 61*a* for receiving the above-mentioned securing pin 48.

Disposed adjacent the inclined surface 58 at the other side wall of the pressure jaw 47 is an oppositely extending upwardly directed wedge or taper surface 66 at an angle i of 45°.

In the embodiment shown in FIGS. 18 and 19 of the top left pressure jaw 46, the surfaces 58, 60 and 66 are inclined to the same extent, but here the wedge or taper surface 66 faces downwardly.

The dimension of the transverse stroke movement F3 produced upon actuation of the pressure jaws 46, 47 is identified by k. The lower left pressure jaw 47 is emphasised by hatching in FIGS. 7 and 8 for the sake of enhanced clarity thereof.

Various crimping inserts 30 with the crimping punches 28 diagrammatically shown in FIG. 6 can now be mounted in the crimping tool 20; in the transverse stroke movement x of the pressure jaws 46, 47, they are urged by the taper surface 66 towards the center Z; F3 is converted into F4.

The return of the crimping punches 28 is effected by springs (not shown) as soon as the taper surfaces 66 have disengaged the end surfaces 29 of the crimping punches 28. When the crimping punches 28 move apart, the feed opening defined by the tips 27 thereof is enlarged.

I claim:

1. An apparatus for connecting a contact element to a wire comprises: an impact press having a housing; a crimping insert interchangeably disposed within said housing, said crimping insert having a central axis M; a plurality of crimping punches arranged about said central axis M in guide means such that said guide means intersect at a central aperture for receiving the wire and contact element; motor means for moving said crimping punches toward and away from said central aperture for connecting the wire to the contact element, said motor means comprises a plurality of pressure jaws and pressure punches corresponding to said plurality of crimping punches, each pressure jaw associated with each of said plurality of crimping punches and each pressure punch associated with each pressure jaw wherein each pressure punch lies on an axis substantially parallel to said central axis M and is provided with an inclined surface with respect to the central axis M, said inclined surface of said pressure punch engages an associated surface on each pressure jaw.

2. An apparatus according to claim 1 wherein each crimping punch is provided with a punch surface which acts on a tapered surface of a respective pressure jaw wherein the tapered surface and punch surface are parallel.

3. Apparatus according to claim 1 wherein the pressure punch is connected to a rotary head which is connected to a press ram for raising and lowering the pressure punch.

4. An apparatus according to claim 1 wherein each pressure jaw is provided with an inclined surface which is substantially parallel to and cooperates with said inclined surface on said pressure punches for moving said crimping punches away from said central aperture.

5. An apparatus according to claim 4 wherein each crimping punch is provided with a punch surface which acts on a tapered surface of a respective pressure jaw wherein the tapered surface and punch surface are parallel.

6. Apparatus according to claim 4 wherein a block of material forms the pressure jaw, the tapered surface and inclined oblique groove wherein the groove provides the inclined surfaces for the pressure punches.

7. Apparatus according to claim 6 wherein a rib engages the inclined groove in the pressure jaw, said rib projects from the pressure punch and is provided with the inclined surfaces of the pressure punch.

8. Apparatus according to claim 1 wherein the crimping punch is moved toward said central aperture against the force of a biasing means.

9. Apparatus according to claim 8 wherein the pressure jaw is moved towards the crimping punch against the force of a biasing means.

10. Apparatus according to claim 9 wherein the biasing means engages a securing pin which is connected to the pressure jaw and which passes through a fixed guide.

11. Apparatus according to claim 10 wherein the guide for the securing pin is a bore in the housing and slide tracks for the pressure jaws extend in the housing.

12. Apparatus according to claim 11 wherein thrust tracks for the pressure punches extend transversely to the slide tracks.

13. Apparatus according to claim 12 wherein a crimping insert is disposed between the thrust tracks, the crimping insert is provided with guides for the crimping punches.

14. Apparatus according to claim 13 wherein the guides extend radially relative to the central aperture in the crimping insert.

15. Apparatus according to claim 14 wherein the central aperture tapers towards the guide mean.

16. An apparatus for connecting a contact element to a wire comprises: an impact press having a housing; a crimping insert interchangeably disposed within said housing, said crimping insert having a central axis M; a plurality of crimping punches arranged about said central axis M in guide means such that said guide means intersect at a central aperture adapted for receiving the wire and contact element; motor means for moving said crimping punches toward and away from said central aperture for connecting the wire to the contact element, said motor means comprises a plurality of pressure jaws and pressure punches corresponding to said plurality of crimping punches, each pressure jaw associated with each of said plurality of crimping punches and each pressure punch associated with each pressure jaw wherein each pressure punch lies on an axis substantially parallel to said central axis M, wherein each pressure jaw is provided with an inclined surface which is substantially parallel to and cooperates with an inclined surface on said pressure punches for moving said crimping punches away from said central aperture.

17. An apparatus according to claim 16 wherein each crimping punch is provided with a punch surface which acts on a tapered surface of a respective pressure jaw wherein the tapered surface and punch surface are parallel.

18. Apparatus according to claim 16 wherein the cooperating surfaces of the pressure jaw and the pressure punch for moving said crimping punches away from said central aperture are inclined relative to the central axis M.

19. An apparatus for connecting a contact element to a wire comprises: an impact press having a housing; a crimping insert interchangeably disposed within said house, said crimping insert having a central axis M; a plurality of crimping punches arranged about said central axis M in guide means such that said guide means intersect at a central aperture for receiving the wire and contact element; motor means for moving said crimping punches toward and away from said central aperture for connecting the wire to the contact element, said motor means comprises a plurality of pressure jaws and pressure punches corresponding to said plurality of crimping punches, each pressure jaw associated with each of said plurality of crimping punches and a pressure punch associated with each pressure jaw wherein each pressure punch lies on an axis substantially parallel to said central axis M, wherein each crimping punch is provided with a punch surface which acts on a tapered surface of a respective pressure jaw wherein the tapered surface and punch surface are parallel.

20. Apparatus according to claim 19 wherein each crimping punch has a longitudinal axis which extends at approximately a right angle with respect to the taper surface.

* * * * *

UNITED STATES PATENT AND TRADEMARK OFFICE

CERTIFICATE OF CORRECTION

PATENT NO. : 5,477,608

DATED : December 26, 1995

INVENTOR(S) : Matthias Woll

It is certified that error appears in the above-indentified patent and that said Letters Patent is hereby corrected as shown below:

Claim 15, line 62 of column 6, "mean" should be --means--.

Claim 19, line 13 of column 8, "a" should be --each--.

Claim 20, last line of column 8, "taper" should be --tapered--.

Signed and Sealed this

Tenth Day of September, 1996

*Attest:*

*Attesting Officer*

BRUCE LEHMAN

*Commissioner of Patents and Trademarks*